US007321347B2

(12) United States Patent
Yaguma et al.

(10) Patent No.: US 7,321,347 B2
(45) Date of Patent: Jan. 22, 2008

(54) ORGANIC EL ELEMENT DRIVE CIRCUIT AND ORGANIC EL DISPLAY DEVICE USING THE SAME DRIVE CIRCUIT

(75) Inventors: Hiroshi Yaguma, Kyoto (JP); Shinichi Abe, Kyoto (JP); Jun Maede, Kyoto (JP); Akio Fujikawa, Kyoto (JP)

(73) Assignee: Rohm Co., Ltd., Kyoto (JP)

( * ) Notice: Subject to any disclaimer, the term of this patent is extended or adjusted under 35 U.S.C. 154(b) by 807 days.

(21) Appl. No.: 10/822,655

(22) Filed: Apr. 13, 2004

(65) Prior Publication Data

US 2004/0207580 A1 Oct. 21, 2004

(30) Foreign Application Priority Data

Apr. 15, 2003 (JP) ..... 2003-110322

(51) Int. Cl.
*G09G 3/30* (2006.01)

(52) U.S. Cl. ..... 345/76; 345/82; 345/98; 315/169.3

(58) Field of Classification Search ..... 345/55–100, 345/204–214; 315/169.1–169.4
See application file for complete search history.

(56) References Cited

U.S. PATENT DOCUMENTS 6,229,267 B1 * 5/2001 Ushigusa et al. ..... 345/214
6,714,177 B1 * 3/2004 Ishizuka ..... 345/76

FOREIGN PATENT DOCUMENTS

JP 9-232074 9/1997
JP 2001-143867 5/2001

* cited by examiner

*Primary Examiner*—David L. Lewis
(74) *Attorney, Agent, or Firm*—Mattingly, Stanger, Malur & Brundidge, P.C.

(57) ABSTRACT

An organic EL drive circuit comprises a timing signal generator circuit for generating a plurality of second timing control signals sequentially delayed from a first timing control signal, a reset pulse generator circuit for selecting one of the plurality of the second timing control signals according to the predetermined data and generating a reset pulse having a front edge determined according to the selected second timing control signal and a rear edge determined by the first timing control signal and a switch circuit responsive to the reset pulse for connecting the terminal pins to a predetermined bias line to reset an organic EL element of an organic EL panel connected to the terminal pins. Luminance of the organic EL panel is regulated by regulating the display period according to the predetermined data.

17 Claims, 3 Drawing Sheets

ORGANIC EL ELEMENT DRIVE CIRCUIT AND ORGANIC EL DISPLAY DEVICE USING THE SAME DRIVE CIRCUIT

BACKGROUND OF THE INVENTION

1. Field of the Invention

The present invention relates to an EL (electro luminescent) element drive circuit and an organic EL display device using the same drive circuit and, in particular, the present invention relates to an organic EL display device suitable for high luminance color display, with which white balance on a display screen of a display device of an electronic device such as a portable telephone set or a PHS, etc., can be easily regulated or variation of luminance can be reduced, by luminance regulation of R (red), G (green) and B (blue) colors.

2. Description of the Prior Art

An organic EL display panel of an organic EL display device, which is mounted on a portable telephone set, a PHS, a DVD player or a PDA (personal digital assistance) and includes 396 (132×3) terminal pins for column lines and 162 terminal pins for row lines, has been proposed and the number of column lines and the number of row lines of such organic EL display panel tend to be further increased.

An output stage of a current drive circuit of such organic EL display panel includes an output circuit constructed with, for example, current-mirror circuits, which are provided correspondingly to respective terminal pins of the panel, regardless of the type of drive current, the passive matrix type or the active matrix type.

One of the problems of a conventional organic EL display device is that, when the voltage drive is used to drive terminal pins thereof as in a liquid crystal display device, a display control becomes difficult and luminance variation becomes conspicuous due to difference in luminous sensitivity between R, G and B display colors. For this reason, the organic EL display device has to be current-driven. However, even when the current drive is employed, ratio of light emission efficiency for drive currents of R, G and B colors is, for example, R:G:B=6:11:10, which depends upon luminescent materials of the organic EL elements.

In view of this, it is necessary, in a current-drive circuit of an organic EL color display device, that white balance is obtained on a display screen thereof by regulating luminance of each of R, G and B colors correspondingly to luminescent materials of EL elements for respective R, G and B colors. In order to realize such white balance regulation, regulation circuits for regulating luminance of respective R, G and B colors on the display screen are provided.

Incidentally, JPH9-232074A discloses a drive circuit for organic EL elements, in which the organic EL elements arranged in a matrix are current-driven and a terminal voltage of each organic EL element is reset by grounding an anode and a cathode of the organic EL element. Further, JP2001-143867A discloses a technique with which power consumption of an organic EL display device is reduced by current-driving organic EL elements with using DC-DC converters.

It is usual in the conventional organic EL display device that the current-drive circuit of the organic EL display device generates drive currents for driving organic EL elements connected to respective column line pins by current-amplifying reference currents for R, G and B display colors and the regulation of drive currents for obtaining white balance is performed by regulating the reference currents for the respective R, G and B display colors.

In order to regulate the reference currents for the respective R, G and B colors, each of reference current generator circuits of a conventional drive current regulator circuit includes a D/A converter circuit of, for example, 4 bits and the reference currents for the respective R, G and B display colors are regulated by setting a predetermined bit data for each of R, G and B display colors at 5 μA intervals within a range, for example, from 30 μA to 75 μA. With the fact that various organic EL materials have been developed recently, the luminance regulation for realizing white balance, which is realizable by the D/A converter circuits, is not enough since the dynamic range of regulation is as rough as 4 bits.

However, if the number of bits of the D/A converter circuit for luminance regulation of each of R, G and B display colors is increased, the terminal pins of the column lines have to be driven by a plurality of drive ICs and each drive IC has to drive a plurality of terminal pins. As a result, the current output characteristics of drive circuits of current sources corresponding to the respective terminal pins is varied and so luminance variation of the organic EL display panel driven thereby becomes conspicuous.

SUMMARY OF THE INVENTION

An object of the present invention is to provide an organic EL drive circuit capable of precisely regulating white balance even when dynamic range of regulation of a reference current value for each of R, G and B is small. Another object of the present invention is to provide an organic EL display device using the same organic EL drive circuit.

A further object of the present invention is to provide an organic EL drive circuit capable of easily reduce luminance variation and another object of the present invention is to provide an organic EL display device using the same organic EL drive circuit.

In order to achieve the above objects, the organic EL drive circuit for current-driving organic EL elements through terminal pins of an organic EL display panel in a display period corresponding to a scan period of one horizontal line by separating the display period from a reset period corresponding to a retrace period of a horizontal scan by a first timing control signal having a predetermined frequency is featured by comprising a timing signal generator circuit for generating a plurality of second timing control signals, which are sequentially delayed from the first timing control signal at a predetermined time intervals, a reset pulse generator circuit for generating a reset pulse by selecting one of the second timing control signals according to a predetermined data and determining a front edge (a rising or falling edge) of the reset pulse according to the selected second timing control signal and a rear edge (a falling or rising edge) thereof corresponding to the first timing control signal and a switch circuit responsive to the reset pulse for resetting charges of the organic EL elements connected to the terminal pins by connecting the terminal pins to a bias line, wherein luminance of the organic EL panel is regulated by regulating the display period according to the predetermined data.

Since the organic EL element for R display color is pre-charged to a predetermined constant voltage $V_{ZR}$ and emits light after the constant voltage resetting, a drive current waveform of the organic EL element driven through each column terminal pin of the organic EL drive circuit for R color starts from the predetermined constant voltage $V_{ZR}$ as shown by a solid line in FIG. 3(*g*). Incidentally, a dotted line in FIG. 3(*g*) shows a voltage waveform.

The constant voltage resetting is performed in the reset period corresponding to the retrace period of the horizontal scan and the display period in this case corresponds to the horizontal scan period of one horizontal line. Therefore, the separation between the display period and the reset period is performed by a timing control pulse having a period (horizontal scan frequency) corresponding to a sum (display period+reset period). Incidentally, FIG. 3(*a*) to FIG. 3(*j*) show drive current waveforms for the terminal pins and various timing signals for generating the drive current waveforms.

In detail, FIG. 3(*a*) shows a sync clock CLK on which timings of various control signals are determined, FIG. 3(*b*) shows a count start pulse CSTP of a pixel counter, FIG. 3(*c*) shows a count value of the pixel counter, FIG. 3(*d*) shows a display start pulse DSTP, FIG. 3(*e*) shows the reset pulse $RS_R$ for R display color, FIG. 3(*h*) shows a reset pulse $RS_G$ for G display color, FIG. 3(*h*) shows a reset pulse $RS_B$ for B display color and FIG. 3(*i*) shows a reset pulse $RS_B$ for B display color.

As shown in FIG. 3(*e*), FIG. 3(*h*) and FIG. 3(*i*), end time points of the display periods for R, G and B colors are made different by making the reset periods of the reset pulses for R, G and B display colors different.

In other words, according to the present invention, the reset periods for R, G and B display colors are regulated by externally setting the data corresponding to R, G and B colors to regulate the end time points of the display periods of R, G and B colors to thereby regulate luminance of R, G and B colors. Alternatively, the present invention makes the luminance regulation possible correspondingly to the respective terminal pins by regulating the reset periods correspondingly to the respective terminal pins.

Therefore, the reset periods of the terminal pins for R, G and B display colors and hence the white balance regulation can be regulated. Further, it is possible to reduce the luminance variation by regulating the reset periods of those of the respective terminal pins, which are selected correspondingly to the luminance variation.

As a result, it is possible to easily realize an organic EL drive circuit capable of regulating white balance or of reducing luminance variation and an organic EL display panel using the same organic EL drive circuit.

DETAILED DESCRIPTION OF THE PREFERRED EMBODIMENTS

Figure 1:
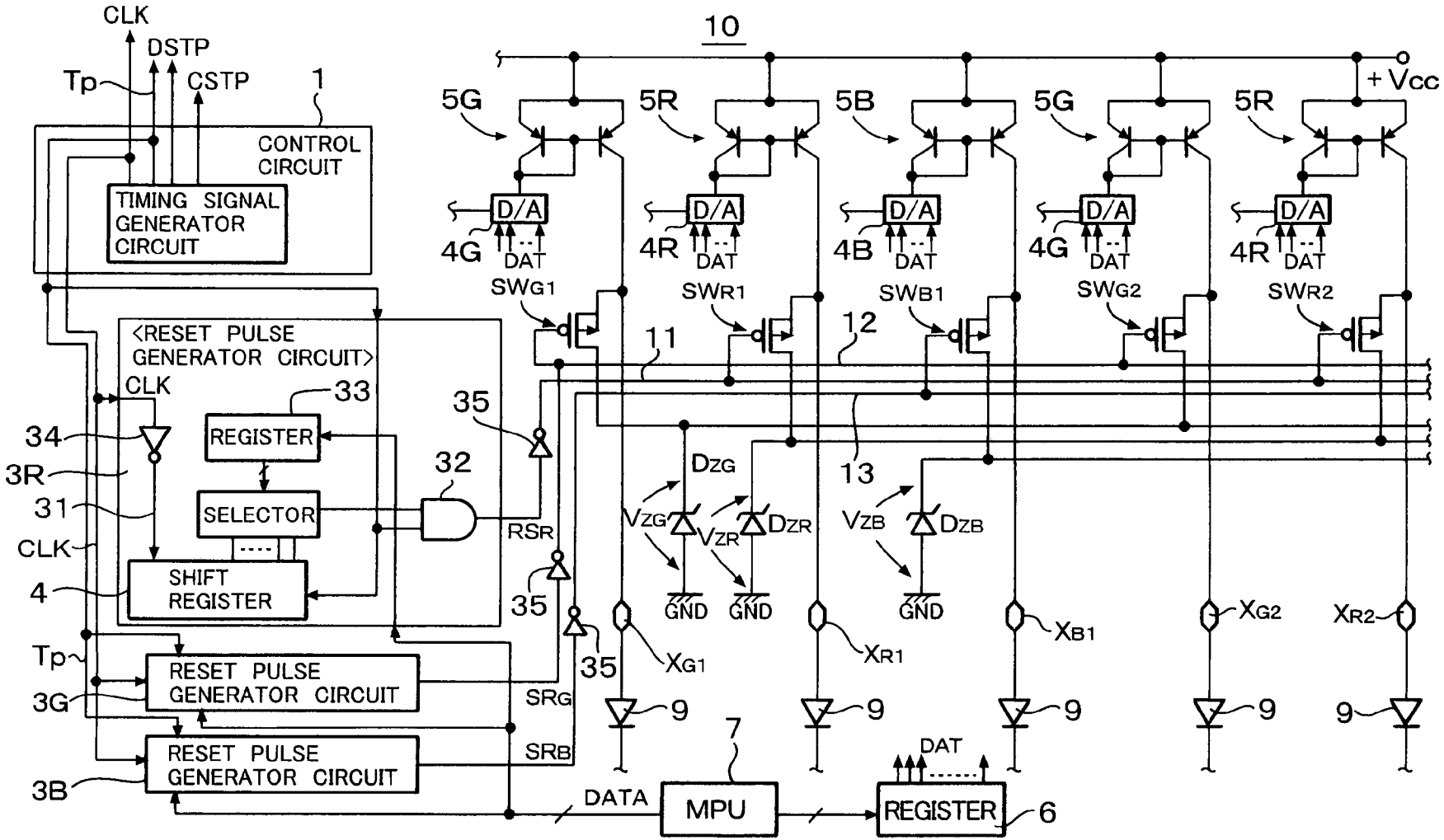
FIG. 1 is a block circuit diagram of an organic EL drive circuit of an organic EL panel, according to an embodiment of the present invention.

In FIG. 1, a column driver 10 functions as an organic EL drive circuit of an organic EL panel. The column driver 10 includes a control circuit 1, an n-stage shift register 2, where n is an integer equal to or larger than 2, reset pulse generator circuits 3R, 3G and 3B for respective R, G and B colors, D/A converter circuits 4R, 4G and 4B for respective R, G and B colors, output stage current sources 5R, 5G and 5B for respective R, G and B colors and a register 6.

Each of the D/A converter circuits 4R receives a display data DAT from an MPU 7 through the register 6 and generates a drive current corresponding to a display luminance every time by amplifying a reference drive current for R display color, which is generated by a reference current generator circuit (not shown), correspondingly to the display data value. The output stage current sources 5R are driven by the thus generated drive current.

Each of the output stage current sources 5R is constructed with a current mirror circuit including a pair of transistors and outputs the drive current for R color to anodes of respective organic EL elements 9 of the organic EL panel through a plurality (m) of output terminals $X_{R1}, X_{R2}, \ldots, X_{Rm}$. The output terminals $X_{R1}, X_{R2}, \ldots, X_{Rm}$ for R display color are grounded through a constant voltage Zener diode $D_{ZR}$ connected commonly to switch circuits $SW_{R1}, SW_{R2}, \ldots, SW_{Rm}$.

Since the D/A converters 4G and the output stage current sources 5G for G display color and the D/A converters 4B and the output stage current sources 5B for B display color are similar to the D/A converters 4R and the output stage current sources 5R for R display color, respectively, details of constructions thereof for G and B display colors are omitted for simplicity of description. Output terminals $X_{G1}, X_{G2}, \ldots, X_{Gm}$ connected to the output stage current sources 5G are connected to anodes of respective organic EL elements 9 for G color and are grounded through respective switch circuits $SW_{G1}, SW_{G2}, \ldots, SW_{Gm}$ and a constant voltage Zener diode $D_{ZG}$. Output terminals $X_{B1}, X_{B2}, \ldots, X_{Bm}$ connected to the output stage current sources 5B are connected to anodes of respective organic EL elements 9 for B color and are grounded through respective switch circuits $SW_{B1}, SW_{B2}, \ldots, SW_{Bm}$ and a constant voltage Zener diode $D_{ZB}$.

In the following description, the constructions of the D/A converter circuit 4R and the output current sources 5R for R display color will be described mainly.

As shown in FIG. 1, the switch circuits $SW_{R1}, SW_{R2}, \ldots, SW_{Rm}$ are reset switches provided correspondingly to the output terminals $X_{R1}, X_{R2}, \ldots, X_{Rm}$ and function to reset the respective output terminals to the constant voltage $V_{ZR}$ of the Zener diode $D_{ZR}$. The switch circuits $SW_{R1}, SW_{R2}, \ldots, SW_{Rm}$ are constructed with transistors, for example, P channel MOS transistors, respectively. Gates of the P channel MOS transistors are connected to a line 11 and receive a reset pulse $RS_R$ from the reset pulse generator circuit 3R.

Sources of the P channel MOS transistors are connected to the respective output terminals $X_{R1}$ to $X_{Rm}$ and drains thereof are grounded through the Zener diode $D_{ZR}$. Therefore, the anodes of the organic EL elements 9 for R color are pre-charged to the constant voltage $V_{ZR}$ of the Zener diode $D_{ZR}$ in the reset period.

Similarly, the P channel MOS transistors constituting the switch circuits $SW_{G1}, SW_{G2}, \ldots, SW_{Gm}$ for G display color are provided correspondingly to the respective output terminals $X_{R1}$ to $X_{Rm}$ as shown in FIG. 1. Sources of the P channel MOS transistors for G color are grounded through the Zener diode $D_{ZG}$ and drains thereof are connected to a line 12. A reset pulse $RS_G$ from the reset pulse generator circuit 3G for G color is supplied to the drains through the line 12.

Similarly, the P channel MOS transistors constituting the switch circuits $SW_{B1}, SW_{B2}, \ldots, SW_{Bm}$ for B display color are provided correspondingly to the respective output terminals $X_{B1}$ to $X_{Bm}$. Sources of the P channel MOS transistors are grounded through the Zener diode $D_{ZB}$ and drains thereof are connected to a line 13. A reset pulse $RS_B$ from the reset pulse generator circuit 3B is supplied to the drains through the line 13.

Since the reset pulse generator circuits 3R, 3G and 3B are identical, the reset pulse generator circuit 3R for R display color will be described in detail. The reset pulse generator circuit 3R includes a selector 31, a 2-input AND gate 32, a 3-bit register 33 and an inverter 34. In response to a timing control pulse Tp from the control circuit 1 and the clock signal CLK through the inverter 34, the shift register 4 generates output waveforms shown in FIG. 2(*a*) in respective stages thereof in synchronism with a falling edge of the clock signal CLK.

Figure 2A:
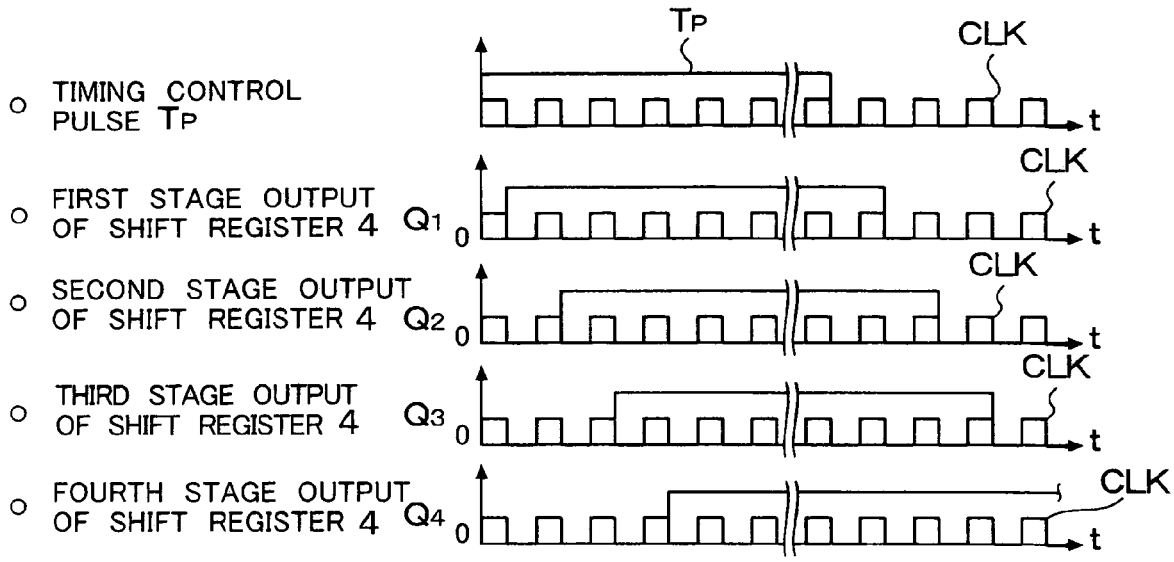
FIG. 2(*a*) and FIG. 2(*b*) show waveforms of timing signals for controlling the organic EL drive circuit shown in FIG. 1.
Figure 2B:
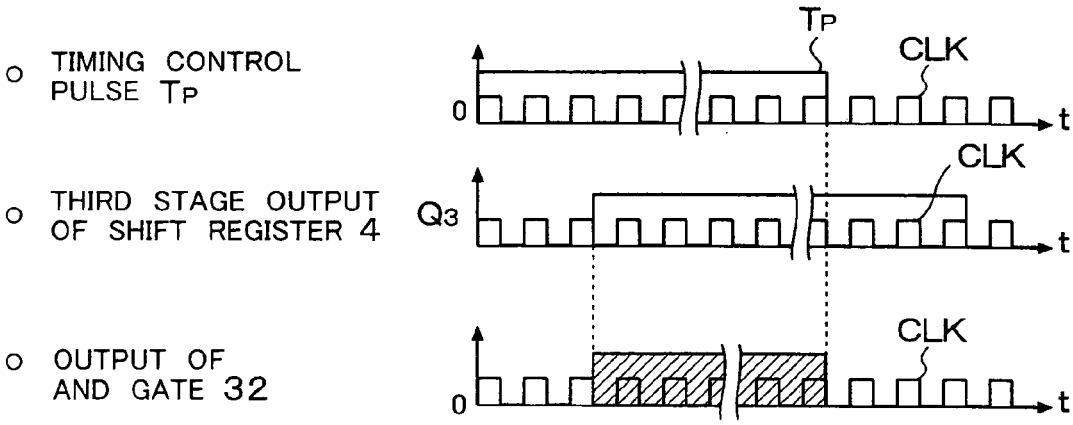

Incidentally, in FIG. 2(*a*), the shift register 4 is a 4-stage shift register constructed with four flip-flop circuits Q1 to Q4. An output signal of the flip-flop circuits Q1 is generated in synchronism with the falling edge of the clock signal CLK, an output signal of the flip-flop circuit Q2 is delayed from the rising edge of the output signal of the flip-flop Q1 by a time period corresponding to one clock signals, an output signal of the flip-flop circuit Q3 is delayed from the rising edge of the output signal of the flip-flop circuit Q2 by the time period, and so on, although, in FIG. 2(*a*), the delay time period between adjacent the flip-flop circuits corresponds to one clock signal. The timing of the rising edge of the output signal of the flip-flop Q1 is delayed from the rising edge of the timing control pulse Tp by a time from the rising edge of the timing control pulse to the falling edge of the clock synchronized with the timing control pulse.

The selector 31 receives the output signals of the flip-flop circuits of the 4-stage shift register 4 and the timing control pulse Tp from the control circuit 1 and selects one of the output signals of the shift register 4 according to the timing control pulse Tp. This selection of the output signal is performed according to the k-bit data set in the register 33, where k is an integer equal to or larger than 2. The thus selected output signal is inputted to one input of the 2-input AND gate 32 and an input signal of the shift register 4, that is, the timing control pulse Tp, is inputted to the other input of the AND gate 32.

Figure 3:
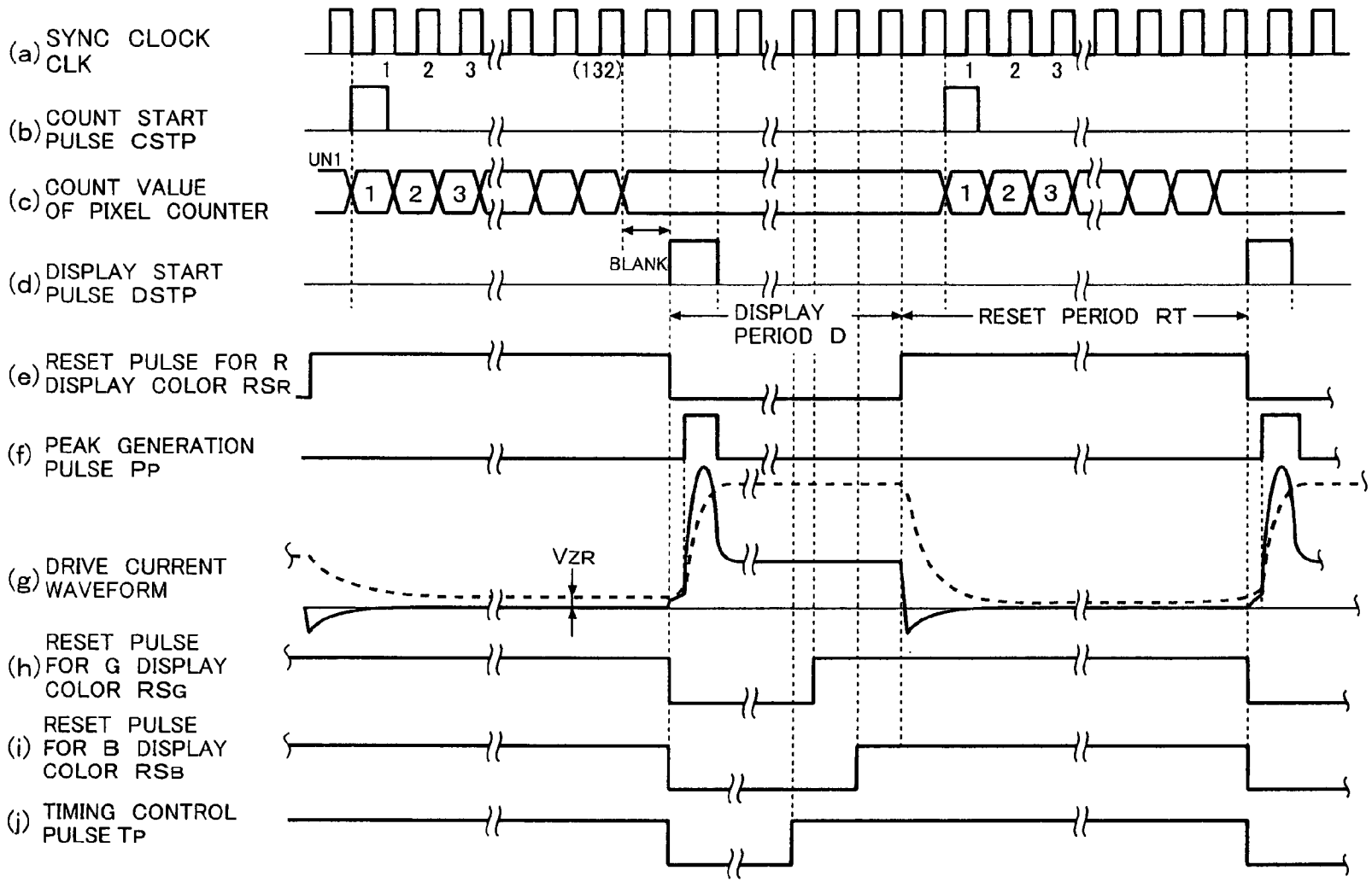
FIG. 3(*a*) to FIG. 3(*j*) show current waveforms for driving terminal pins of the organic EL panel and timing signal waveforms for generating the current waveforms.

As a result, the AND gate 32 generates a reset pulse $RS_R$ delayed from the output of the first stage flip-flop Q1 of the shift register 4 by m clock pulses according to the k-bit data set in the register 33, where m is an integer equal to or larger than 1. A rising edge of the reset pulse $RS_R$ corresponds to the rising edge of the timing control pulse Tp or the rising edge of the output signal of the selected one of the flip-flop circuits Q1 to Q4 of the shift register 4 and the falling edge of the reset pulse $RS_R$ corresponds to the falling edge of the timing control pulse Tp, as shown in FIG. 3(*e*). The reset pulse $RS_R$ generated by the AND gate 32 is sent to the gates of the P channel MOS transistors of the switch circuits $SW_{R1}$, $SW_{R2}$, . . . , $SW_{Rm}$ through the inverter 35. Incidentally, the AND gate 32 and the inverter 35 may be constructed with a NAND gate.

With the number n of the stages of the shift register 4 being 4 and the bit number k of the register 33 being 3, the value of the 3-bit data set in the register 33 takes any one of 0, 1, 2, 3 and 4, which correspond to the respective four stages of the shift register 4. Therefore, assuming that the 3-bit data set in the register 33 of the reset pulse generator circuit 3R is "011", which is 3, the output of the flip-flop Q3 of the shift register 4 is selected as shown in FIG. 3(*c*). Therefore, the output of the AND gate 32 is delayed from the output of the first stage flip-flop circuit Q1 of the shift register 4 by a time corresponding to 2 clocks as shown in FIG. 3(*c*).

As a result, the reset pulse $RS_R$ shown in FIG. 3(*c*) is generated by the reset pulse generator circuit 3R. In the case of the reset pulse $RS_G$ shown in FIG. 3(*h*), the 3-bit data set in the register 33 of the reset pulse generator circuit 3G is "010" which is 2, the output of the flip-flop Q2 of the shift register 4 is selected and, in the case of the reset pulse $RS_B$ shown in FIG. 3(*i*), the 3-bit data set in the register 33 of the reset pulse generator circuit 3B is "001" which is 1, the output of the flip-flop Q1 of the shift register 4 is selected. Incidentally, in FIG. 3(*a*) and FIG. 3(*j*), it is assumed that the outputs of the respective stages of the shift register 4 are generated at the falling edges of the clock pulses.

As mentioned, the reset pulses for R, G and B colors are generated according to data set in the 3-bit registers 33 in synchronism with the falling timing of the clock pulses by the reset pulse generator circuits 3R, 3G and 3B. Further, the thus generated reset pulses fall at the falling edge of the timing control pulse Tp. As a result, it is possible to regulate the end time points of the display periods of R, G and B colors. Therefore, the display periods, that is, luminance, of R, G and B color can be regulated.

When the values of the respective registers 33 are 0, respectively, the reset pulse generator circuits 3R, 3G and 3B output the timing control pulses Tp as the reset pulses. Incidentally, the rising timing of the timing pulse Tp is coincident with the rising timing of the clock pulse. However, if the pulse shown in FIG. 3(*h*) is the timing control pulse Tp, it is possible to generate the timing control pulse Tp coincidently with the falling timing of the clock pulse CLK.

The reset pulses $RS_R$, $RS_G$ and $RS_B$ have periods (horizontal scan frequency) corresponding to predetermined periods each being the sum (display period+reset period) and the reset periods RT start when the levels of these pulses are HIGH (significant) as shown by the reset pulse $RS_R$ in FIG. 3(*e*). The display periods D start coincidently with the rising of the display start pulse DSPT shown in FIG. 3(*d*) and the reset periods are ended in synchronism with the start of the display period D. Therefore, the timing control pulse Tp falls at the end time point of the reset period as a reference. A count of clock pulses is started by a counter, etc., at the falling timing of the timing control pulse Tp and the pulse Tp becomes LOW level within a predetermined constant period. A next rising timing of the pulse Tp is determined correspondingly to the count-up of the counter.

As a result, the waveform of drive current shown by a solid line in FIG. 3(*g*) for driving the organic EL elements 9 for, for example, R display color, is generated correspondingly to the peak generation pulse $P_p$ shown in FIG. 3(*f*).

Incidentally, in the reset periods, for which the reset pulses $RS_R$, $RS_G$ and $RS_B$ are in HIGH level as shown in FIG. 3(*e*), FIG. 3(*h*) and FIG. 3(*i*), the setting of various data such as display data, etc., and the constant voltage setting of the anode voltages of the organic EL display elements 9 are performed. Particularly, the data are set in the display data registers such as the registers 6 provided correspondingly to the respective terminal pins, when these reset signals are in HIGH level. Therefore, when the total number of the terminal pins for R, G and B display colors is 132, at least 133 clock pulses must be counted in the periods in which the respective reset pulses $RS_R$, $RS_G$ and $RS_B$ are in HIGH level according to the values of the pixel counter, as shown in FIG. 3(*c*).

For R display color, the rising edge of the reset pulse $RS_R$ corresponds to the end of the display period. This is also true for G and B display colors.

In view of this, it is possible to change the display period for each of R, G and B colors by setting the rising time points of the reset pulses $RS_R$, $RS_G$ and $RS_B$ according to external data and luminance of each color display is regulated correspondingly. Thus, it becomes possible to regulate white balance.

The data is set in the register 33 of each of the reset pulse generator circuits 3R, 3G and 3B from the MPU 7. Therefore, it is possible to regulate the rising positions of the respective reset pulses $RS_R$, $RS_G$ and $RS_B$ by the data set from the MPU 7. For example, it is possible that the values of the data are stored in a non-volatile memory provided within the MPU 7 and set in the respective registers 33 when a power switch is turned ON. Alternatively, the set data may be stored in a non-volatile memory according to the input data. Particularly, it is preferable to regulate white balance by inputting the data to the MPU 7 and writing the data in the non-volatile memory from a key board in a test stage in shipping organic EL display panels.

Although the reset pulse generator circuits 3R, 3G and 3B are provided correspondingly to R, G and B colors in this embodiment, it is possible to provide a reset pulse generator circuit for each of the output terminals for R, G and B colors. In such case, the luminance regulation can be made for each output terminal.

As a result, data from the MPU 7 for reducing luminance variation are set in the registers 33 of the reset pulse generator circuits provided for the terminal pins at which there are luminance variation. Therefore, it is possible to reduce the luminance variation by regulating the luminance of vertical lines corresponding to the terminal pins.

Incidentally, the data set in the registers 33 may be set externally of the reset pulse generator circuits by a controller instead of the MPU.

As described, the timing control signal, which is delayed from the timing control pulse Tb by the predetermined time selected by the selector 31, is generated by the delay circuit (shift register). However, the timing control signal may be generated by a general timing signal generator circuit.

Incidentally, although the High level of the reset pulses $RS_R$, $RS_G$ and $RS_B$ are significant in the described embodiment, it is possible to use the Low level thereof as significant logic level.

Further, although the reset pulses for G and B display colors are generated by the reset pulse generator circuits provided for the respective display colors, it is possible to a single reset pulse generator may be used commonly for G and B display colors since the difference in light emitting efficiency between G and B colors due to luminescent materials is small at present.

Further, although the pre-charge voltages (constant voltage for constant voltage resetting) of the organic EL elements for R, G and B are independently set by voltages of the Zener diodes $D_{ZR}$, $D_{ZG}$ and $D_{ZB}$, these pre-charge voltages may be the same and it is possible to use a single Zener diode or a single constant voltage circuit. Further, it is possible to provide Zener diodes correspondingly to the respective output terminals. Further, the resetting may be performed for not a constant voltage but the ground potential.

What is claimed is:

1. An organic EL drive circuit for current-driving an organic EL panel through terminal pins thereof in a display period according to a first timing control signal having a predetermined frequency for separating the display period corresponding to a scan period of one horizontal line from a reset period corresponding to a retrace period of the horizontal scan, comprising:

a timing signal generator circuit for generating a plurality of second timing control signals sequentially delayed from said first timing control signal;

a reset pulse generator circuit for selecting one of the plurality of said second timing control signals according to predetermined data and generating a reset pulse having a front edge determined according to said selected second timing control signal and a rear edge determined by said first timing control signal; and a switch circuit responsive to said reset pulse for connecting said terminal pins to a predetermined bias line to reset said organic EL element of said organic EL panel connected to said terminal pins, luminance of said organic EL panel being regulated by regulating said display period according to said predetermined data.

2. The organic EL drive circuit as claimed in claim 1, wherein the front edge of said reset pulse generated by said reset pulse generator circuit corresponds to a front edge of said selected second timing control signal.

3. The organic EL drive circuit as claimed in claim 2, further comprising a register, wherein said timing signal generator circuit is a delay circuit responsive to said first timing control signal for generating the plurality of said second timing control signals by delaying said first timing control signal by predetermined times sequentially and said predetermined data is set in said register.

4. The organic EL drive circuit as claimed in claim 3, wherein said reset circuit includes said register and said predetermined data is set in said register externally of said reset circuit.

5. The organic EL drive circuit as claimed in claim 4, wherein said organic EL panel includes a plurality of said organic EL elements for each of R, G and B display colors, said reset pulse generator circuit and said switch circuit are provided for each of R, G and B display colors and said organic EL elements for each display color are reset respectively.

6. The organic EL drive circuit as claimed in claim 5, wherein said switch circuits for each display color are turned ON according to said reset pulse corresponding thereto to connect anodes of said organic EL elements to said predetermined bias line or a bias line dedicated to the related display color.

7. The organic EL drive circuit as claimed in claim 6, wherein said reset pulse generator circuit is provided for each of said terminal pins and said predetermined data is set correspondingly to said terminal pins.

8. The organic EL drive circuit as claimed in claim 7, wherein said front edge is a rising edge, said rear edge is a falling edge, said delay circuit is constructed with a shift register, said reset pulse generator circuit comprises said register, a selector and an AND or a NAND circuit, said selector selects one of the plurality of said second timing control signals according to said predetermined data and said AND or NAND circuit generates said reset pulse according to said first timing control signal and said selected second timing control signal.

9. The organic EL drive circuit as claimed in claim 8, further comprising a D/A converter circuit provided for each of said terminal pins and a current source provided for each of said terminal pins for current-driving said terminal pins, said D/A converter circuit driving said current source according to the current obtained by the D/A conversion.

10. An organic EL display device for current-driving an organic EL panel through terminal pins thereof in a display period according to a first timing control signal having a predetermined frequency for separating the display period corresponding to a scan period of one horizontal line from a reset period corresponding to a retrace period of the horizontal scan, comprising:

a timing signal generator circuit for generating a plurality of second timing control signals sequentially delayed from said first timing control signal;

a reset pulse generator circuit for selecting one of the plurality of said second timing control signals according to predetermined data and generating a reset pulse having a front edge determined according to said selected second timing control signal and a rear edge determined by said first timing control signal; and a switch circuit responsive to said reset pulse for connecting said terminal pins to a predetermined bias line to reset said organic EL element of said organic EL panel connected to said terminal pins, luminance of said organic EL panel being regulated by regulating said display period according to said predetermined data.

11. The organic EL display device claimed in claim 10, further comprising a register, wherein said timing signal generator circuit is a delay circuit responsive to said first timing control signal for generating the plurality of said second timing control signals by delaying said first timing control signal by predetermined times sequentially and said predetermined data is set in said register.

12. The organic EL display device as claimed in claim 11, wherein said reset circuit includes said register and said predetermined data is set in said register externally of said reset circuit.

13. The organic EL display device as claimed in claim 12, wherein said organic EL panel includes a plurality of said organic EL elements for each of R, G and B display colors, said reset pulse generator circuit and said switch circuit are provided for each of R, G and B display colors and said organic EL elements for each display color are reset respectively.

14. The organic EL display device as claimed in claim 13, wherein said front edge is a rising edge, said rear edge is a falling edge, said switch circuits for each display color are turned ON according to said reset pulse corresponding thereto to connect anodes of said organic EL elements to said predetermined bias line or a bias line dedicated to the related display color.

15. An organic EL drive circuit for current-driving an organic EL panel through terminal pins thereof in a display period according to a timing control signal having a predetermined frequency for separating the display period corresponding to a scan period of one horizontal line from a reset period corresponding to a retrace period of the horizontal scan, comprising:

a timing signal generator circuit for generating a plurality of timing signals sequentially delayed from said timing control signal;

a reset pulse generator circuit for selecting one of the plurality of said timing signals according to predetermined data and generating a reset pulse having a front edge determined according to said selected timing signal and a rear edge determined by said timing control signal; and a switch circuit responsive to said reset pulse for connecting said terminal pins to a predetermined bias line to reset said organic EL element of said organic EL panel connected to said terminal pins, luminance of said organic EL panel being regulated by regulating said display period according to said predetermined data.

16. The organic EL drive circuit as claimed in claim 15, wherein said timing signals are generated by delaying said timing control signal.

17. An organic EL display device for current-driving an organic EL panel through terminal pins thereof in a display period according to a first timing control signal having a predetermined frequency for separating the display period corresponding to a scan period of one horizontal line from a reset period corresponding to a retrace period of the horizontal scan, comprising:

a timing signal generator circuit for generating a plurality of timing signals sequentially delayed from said timing control signal;

a reset pulse generator circuit for selecting one of the plurality of said timing signals according to predetermined data and generating a reset pulse having a front edge determined according to said selected timing signal and a rear edge determined by said timing control signal; and a switch circuit responsive to said reset pulse for connecting said terminal pins to a predetermined bias line to reset said organic EL element of said organic EL panel connected to said terminal pins, luminance of said organic EL panel being regulated by regulating said display period according to said predetermined data.

* * * * *